United States Patent [19]

Hayashi

[11] 4,086,734

[45] May 2, 1978

[54] ADJUSTABLE-HEIGHT BASEBOARD FOR PARTITIONS

[75] Inventor: Muriyoshi Hayashi, Kurobe, Japan

[73] Assignee: Yoshida Kogyo K.K., Tokyo, Japan

[21] Appl. No.: 822,546

[22] Filed: Aug. 8, 1977

[30] Foreign Application Priority Data

Aug. 11, 1976 Japan ..... 51-107988

[51] Int. Cl.[2] ..... E04B 2/74

[52] U.S. Cl. ..... 52/122; 52/238

[58] Field of Search ..... 52/122, 238–243, 52/36

[56] References Cited

U.S. PATENT DOCUMENTS

| | | | |
|---|---|---|---|
| 2,881,876 | 4/1959 | Williams | 52/122 |
| 3,013,642 | 12/1961 | Hammitt et al. | 52/238 |
| 3,049,195 | 8/1962 | Leat et al. | 52/122 |
| 3,231,054 | 1/1966 | Gartrell | 52/122 |
| 3,449,877 | 6/1969 | Beckman | 52/238 |
| 3,487,598 | 1/1970 | Lopina | 52/122 |
| 3,566,559 | 3/1971 | Dickson | 52/122 |
| 3,696,569 | 10/1972 | Didry | 52/122 |

FOREIGN PATENT DOCUMENTS

| | | | |
|---|---|---|---|
| 2,033,737 | 3/1972 | Germany | 152/238 |
| 2,441,903 | 3/1975 | Germany | 52/238 |

*Primary Examiner*—J. Karl Bell

*Attorney, Agent, or Firm*—Hill, Gross, Simpson, Van Santen, Steadman, Chiara & Simpson

[57] ABSTRACT

An adjustable-height baseboard for a partition includes a rail member adapted to be mounted on a floor, the rail member having a pair of spaced lips which are received in a pair of grooves provided in a jointing adapter having a tapped hole into which an elongate connector theadedly extends. A baseboard covering has a channel for receiving therein a lower edge of a partition panel, the covering being connected to the connector. The covering is separable to allow rotation of the connector for adjusting the height of the baseboard.

7 Claims, 6 Drawing Figures

ADJUSTABLE-HEIGHT BASEBOARD FOR PARTITIONS

BACKGROUND OF THE INVENTION

Field of the Invention

The present invention relates to an adjustable-height baseboard for partitions.

SUMMARY OF THE INVENTION

According to the present invention, an adjustable-height baseboard includes a baseboard covering secured to one end of an elongate connector with its other end externally threaded and threadedly extending into a tapped hole in a jointing adapter having a pair of opposite grooves that receive a pair of spaced lips on a rail member, the jointing adapter being movable along the rail member. The baseboard covering has first and second facing members one on each side of the rail member, the first and second facing members being connected together by an interengagement therebetween. The connector has in the one end a coaxial tapped hole into which a screw passes through a portion of the baseboard covering. The connector also has a wrench-engaging portion between its ends.

An object of the present invention is to provide an adjustable-height baseboard for partitions the height of which is easy to change and is of rugged construction.

Another object of the present invention is to provide an adjustable-height baseboard for partitions which upon adjustment is free of shaky movements and can support the partition panel stably.

Still another object of the present invention is to provide an adjustable-height baseboard for partitions that can be easily assembled and disassembled.

Yet another object of the present invention is to provide an adjustable-height baseboard which can be set to correct adjustment.

Many other advantages, features and additional objects of the present invention will become manifest to those versed in the art upon making reference to the detailed description and the accompanying drawings in which a preferred structural embodiment incorporating the principles of the present invention is shown by way of illustrative example.

BRIEF DESCRIPTION OF THE DRAWINGS

FIG. 3 is an enlarged perspective view of a jointing adapter with a connector screwed in;

DETAILED DESCRIPTION OF THE PREFERRED EMBODIMENT

Figure 1:
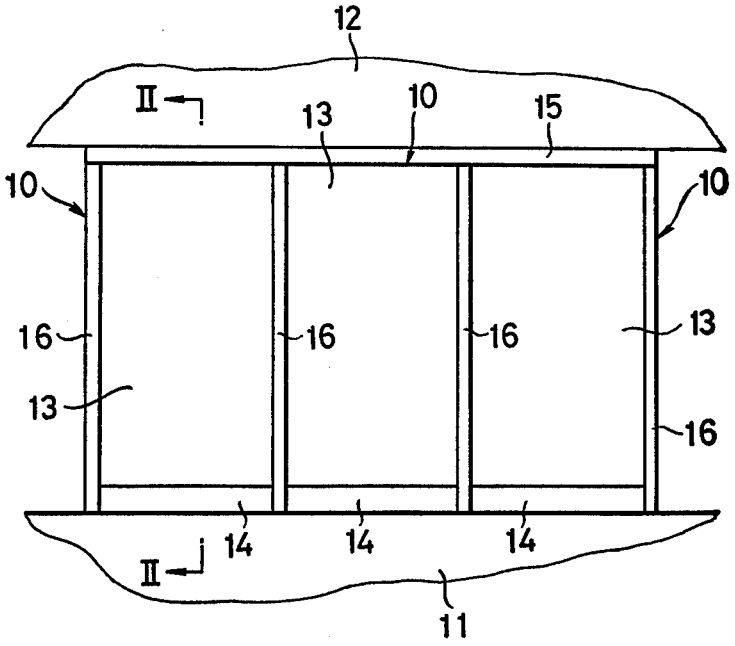
FIG. 1 is a front elevational view of partitions incorporating adjustable-height baseboards constructed in accordance with the invention.

FIG. 1 shows a plurality of partitions 10 extending vertically between a floor 11 and a ceiling 12. Each partition 10 includes a panel 13 such as a board or a sheet of glass, and a baseboard or skirting 14 disposed between the panel 13 and the floor 11, the baseboard 14 being fixed to the floor 11 and supporting thereon the panel 13. A top rail 15 extends between the ceiling 12 and the panels 13 and is secured to the ceiling 12, the top rail 15 holding the panels 13 in position. The panels 13 are spaced side by side and their side edges are protected by spacers 16 mounted thereon.

Figure 2:
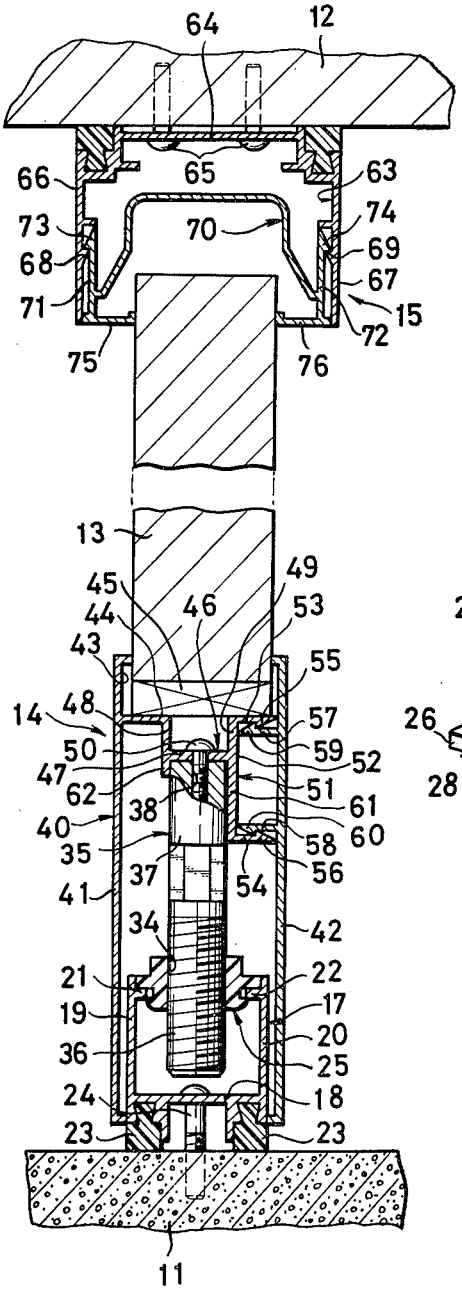
FIG. 2 is an enlarged vertical cross-sectional view taken along line II — II of FIG. 1.

As shown in FIG. 2, the baseboard 14 includes a rail member 17 of generally channel-shaped cross-section having a bottom 18, a pair of spaced side flanges 19,20 each extending at a right angle from the bottom 18, and a pair of lips 21,22 projecting from the side flanges 19,20, respectively, toward each other. The rail member 17 is an extrusion and hence the lips 21,22 extend the length of the rail member 17. The bottom 18 is supported by a pair of sealing members 23,23 on the floor 11 and is fixed to the floor 11 by screws 24 threaded through the bottom 18 into the floor 11.

Figure 3:
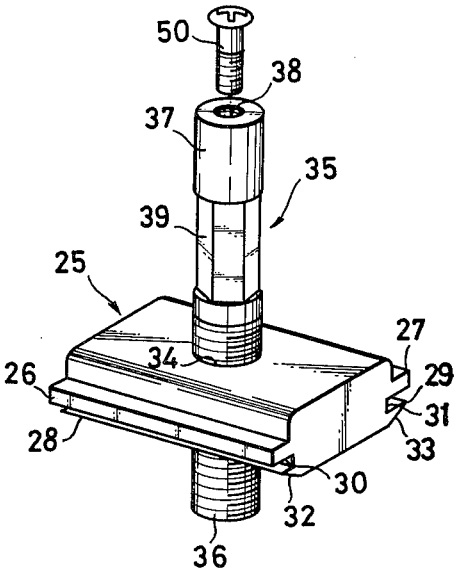

As best shown in FIG. 3, a jointing adapter 25 made of a resilient material such as synthetic resin or hard rubber is in the form of a rectangular plate having a pair of upper projections 26,27 extending one along each side thereof and a pair of lower projections 28,29 extending one along each side thereof. A pair of opposite grooves 30,31 are provided between the upper and lower projections 26,28, 27,29, respectively. The grooves 30,31 receive therein the lips 21,22, respectively. The lower projections 28,29 have a pair of tapered surfaces or bevels 32,33, respectively, sloping toward the grooves 30,31. The jointing adapter 25 has a central tapped hole 34 extending transversely therethrough.

An elongate connector 35 has at its one end an externally threaded portion 36 which threadedly extends into the tapped hole 34 in the jointing adapter 35. The connector 35 has at the other end a cylindrical portion 37 having therein a coaxial tapped hole 38. Between the externally threaded portion 36 and the cylindrical portion 37, there is a wrench-engaging portion 39 of hexagonal cross-section for being gripped and turned by the jaws of a wrench.

FIG. 2 also shows a baseboard covering 40 comprising a first facing member 41 on one side of the rail member 17 and a second facing member 42 on the other side. The first and second facing members 41,42, when coupled together, jointly provide a first channel 43 at their upper portion, the first channel 43 opening toward and receiving the lower edge of the panel 13. The first channel 43 has a bottom 44 extending laterally away from the first facing member 41, the bottom 44 carrying thereon a support 45 that bears the panel 13. A second channel 46 is provided centrally in the bottom 44 of the first channel 43 and opens toward the first channel 43. The second channel 46 includes a bottom 47 and a pair of side walls 48,49. The connector 35 is rotatably connected endwise to the bottom 47 of the second channel 46 by means of a screw 50 threadedly extending into the coaxial tapped hole 38 through the bottom 47.

The first facing member 41 also has a third channel 51 opening laterally toward the second facing member 42 and including a bottom 52 and a pair of upper and lower legs 53,54, the upper leg 53 being a part of the bottom 44 of the first channel 43. The legs 53,54 have a first pair of spaced hooks 55,56, respectively, projecting toward each other into the third channel 51. The second facing member 42 includes a pair of legs 57,58 extending laterally toward the first facing member 41, the legs 57,58 projecting into the third channel 51 of the first facing member 41. The legs 57,58 have a second pair of spaced hooks 59,60, respectively, projecting away from each other and held in interengagement with the first hooks 55,56, respectively. Upon interfitting engagement of the first hooks 55,56 with the second hooks 59,60, the first and second facing members 41,42 are retained together against separation.

The side wall 49 of the second channel 46 has an extension 61 projecting beyond the bottom 47 of the channel 46 and which, together with the side wall 49, constitutes the bottom 52 of the third channel 51. The side wall 48 of the second channel 46 has an extension 62 projecting beyond the bottom 47 of the channel 46, the extension 62 being shorter than the extension 61. The cylindrical portion 37 of the connector 35 is interposed between and held in engagement with the extensions 61,62.

The top rail 15 includes an attachment channel 63 having a bottom 64 fixed to the ceiling 12 by means of screws 65. The attachment channel 63 includes a pair of legs 66,67 having a pair of inwardly directed hooks 68,69, respectively. The top rail 15 has a panel-holding member 70 including a pair of legs 71,72 having a pair of outwardly directed hooks 73,74, respectively, that are held in meshing engagement with the inwardly directed hooks 68,69, respectively. The member 70 has a pair of opposed flanges 75,76 that grip therebetween the upper edge of the panel 13.

Figure 4:
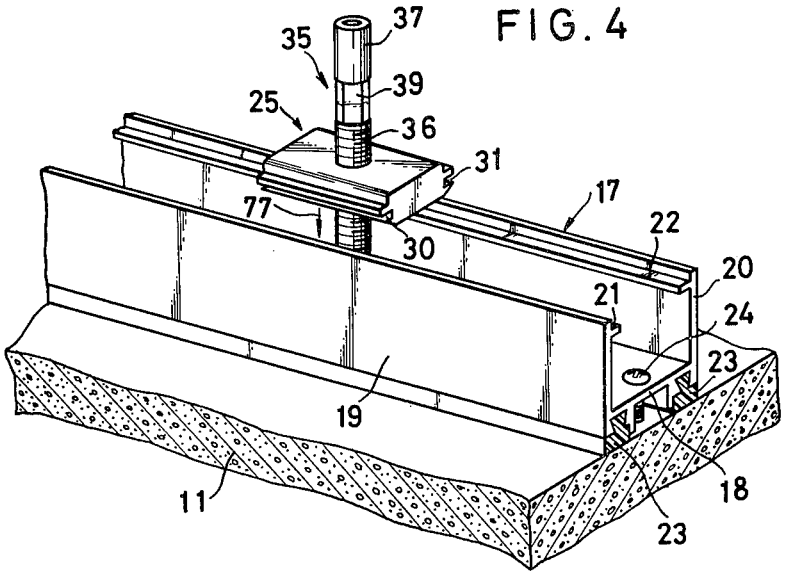
FIG. 4 is an exploded perspective view showing the jointing adapter just before installation onto a rail member.
Figure 5:
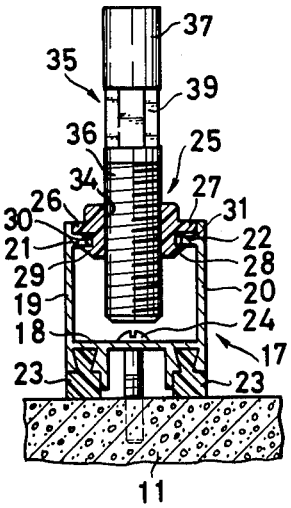
FIG. 5 is a vertical cross-sectional view of the jointing adapter attached to the rail member.

For installation of the partition 10, the rail member 17 and the attachment channel 63 are screwed to the floor 11 and the ceiling 12, respectively, in vertical registration with each other. The jointing adapter 25 with the connector 35 threaded in is pressed down transversely into the channel-shaped rail member 17 in the direction of the arrow 77 as shown in FIG. 4. While the jointing adapter 25 is forcibly depressed, the lower projections 28,29 are engaged at the tapered surfaces 32,33 and deflected by the lips 21,22 yieldingly into the grooves 30,31, respectively. Continued depression of the jointing adapter 25 causes the tapered surfaces 32,33 to slide over the free edges of the lips 21,22, respectively, and when the tapered surfaces 32,33 are squeezed down out of engagement with the lips 21,22, the projections 28,29 spring back into their original shape. At this time, the lips 21,22 are snappingly inserted in the grooves 30,31, respectively, with the upper projections 26,27 above the lips 21,22 and the lower projections 28,29 under the lips 21,22 (FIG. 5). Accordingly, the jointing adapter 25 is retained on the rail member 17 against removal therefrom, but is slidable along the rail member 17. The jointing adapter 25 is thus mounted, and as many jointing adapters as required can be installed on the rail member 17.

Figure 6:
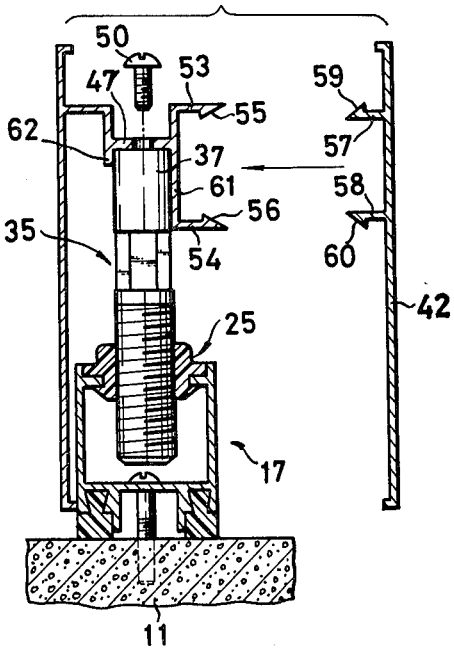
FIG. 6 is an exploded vertical cross-sectional view showing the way in which a baseboard covering is assembled and connected to the connector.

The jointing adapter 25 is moved along to a desired position on the rail member 17. Then, the first facing member 41 is attached with the cylindrical portion 37 of the connector 35 interposed between the extensions 61,62, as shown in FIG. 6. The connector 35 is turned by a wrench until the first facing member 41 is adjusted to a required height. Since the cylindrical portion 37 of the connector 35 frictionally engages the extensions 61,62, the first facing member 41 is supported stably during adjustment. The first facing member 41 is connected to the connector 35 by the screw 50.

The panel-holding member 70 is snapped onto the attachment channel 63 and the panel 13 with the support 45 is installed between the member 70 and the first facing member 41. Finally, the second facing member 42 is connected to the first facing member 41 by bringing the hooks 59,60 snappingly into interfitting engagement with the hooks 55,56, respectively, as illustrated in FIG. 6.

Although various minor modifications may be suggested by those versed in the art, it should be understood the I which to embody within the scope of the patent warranted hereon, all such embodiments as reasonably and properly come within the scope of my contibution to the art.

I claim as my invention:

1. An adjustable-height baseboard for mounting a partition including a panel on a foundation, comprising:

(a) a rail member adapted for being mounted on the foundation, said rail member having a pair of spaced lips extending therealong and projecting toward each other;

(b) a jointing adapter having a tapped hole therein and a pair of opposite grooves receiving said lips therein, said jointing adapter being movable along said rail member;

(c) an elongate connector having at its one end an externally threaded portion which threadedly extends into said tapped hole; and (d) a baseboard covering having means for supporting a lower edge of the panel, said baseboard covering being connected to said connector.

2. An adjustable-height baseboard according to claim 1, said connector having at the other end a coaxial tapped hole, and there being a screw threadedly extending into said coaxial tapped hole through a portion of said baseboard covering.

3. An adjustable-height baseboard according to claim 1, said connector having a wrench-engaging portion between its ends.

4. An adjustable-height baseboard according to claim 2, said baseboard covering including a first facing member on one side of said rail member and a second facing member on the other side, said first and second facing members jointing providing a first channel for the reception therein of the lower edge of the panel, and said first facing member having a second channel having a bottom through which said screw extends.

5. An adjustable-height baseboard according to claim 4, said first channel having a bottom for carrying thereon the lower edge of the panel, and said second channel being provided in said bottom of said first channel.

6. An adjustable-height baseboard according to claim 4, said first facing member having a first pair of spaced hooks, and said second facing member having a second pair of spaced hooks interengaging with said first pair of spaced hooks.

7. An adjustable-height baseboard according to claim 1, said jointing adapter being made of resilient material, and having a pair of tapered surfaces sloping toward said grooves which allow said lips to snap into said grooves during installation of said jointing adapter transversely onto said rail member.

* * * * *